US005424108A

United States Patent [19]

Whetstone

[11] Patent Number: 5,424,108

[45] Date of Patent: Jun. 13, 1995

[54] EDGE MOLDING AND SURFACE TOP ASSEMBLY

[75] Inventor: William F. Whetstone, Cincinnati, Ohio

[73] Assignee: Formica Technology, Inc., Wilmington, Del.

[21] Appl. No.: 187,144

[22] Filed: Jan. 27, 1994

[51] Int. Cl.[6] ..... A47B 95/00

[52] U.S. Cl. ..... 428/99; 428/120; 428/122; 428/156; 428/157; 428/167; 428/192; 248/345.1

[58] Field of Search ..... 428/99, 100, 120, 122, 428/156, 157, 167, 192; 248/345.1; 52/716.8, 716.2, 717.03, 718.06, 823

[56] References Cited

U.S. PATENT DOCUMENTS

| | | | |
|---|---|---|---|
| 2,303,864 | 12/1942 | Reasor | 52/716.2 |
| 2,417,961 | 3/1947 | Wiley | 52/716.2 |
| 2,705,820 | 4/1955 | Torrence | 52/716.2 |
| 3,007,213 | 11/1961 | Hobbs | 52/716.2 |
| 3,416,282 | 12/1968 | Daugherty | 52/716.8 |
| 4,914,888 | 4/1990 | Hanson | 52/823 |
| 5,149,575 | 9/1992 | Soifer | 428/188 |

*Primary Examiner*—Alexander S. Thomas
*Attorney, Agent, or Firm*—Charles R. Wilson

[57] ABSTRACT

An edge molding is shaped to mount on a corestock in a cooperative relationship with a substantially flat surface top to form a two piece surface top assembly which is easy to install yet appears to be seamless. The edge molding has a facing wall, an integral first ledge and an integral second ledge, each extending at substantially right angles from the facing wall. An inside face of the facing wall has at least one longitudinally running excess adhesive flow-out groove and the inside faces of the ledges have longitudinally running gripper ridges. The second ledge preferably also has a drip channel on its outside face to interrupt the flow of spilled liquid. The edge molding and surface top are positioned onto the corestock and adhesively secured thereto. An edge area where the surface top overlaps the edge molding is capable of being routed to a desired shape.

23 Claims, 3 Drawing Sheets

EDGE MOLDING AND SURFACE TOP ASSEMBLY

This invention relates to edge molding. More particulary, the invention relates to an edge molding capable of mounting on a corestock and in a cooperative association with a substantially flat surface top to form an assembly having the appearance of a seamless unitary structure.

Surface tops, particularly kitchen counter tops are found in virtually every residence in the country. Many restaurants and many plant cafeterias also have one or more counter tops as a functional part of a kitchen area or a serving area. Necessary characteristics of any kitchen counter top include a flat top surface which is resistant to food stains, impervious to liquid, resistant to scratches and other surface marrings, and is readily cleaned. Many of these same characteristics are required in other surface tops such as bathroom vanity tops, table tops, and work bench tops. Any surface top must also be attractive to be marketable. Attractiveness of a surface top in large part results from a pleasing color or surface pattern. However, unique edge treatments and a seamless one piece appearance are also important.

Surface tops made from Formica brand laminates are very prevalent. The surface tops comprise a rigid corestock and the Formica brand laminate as a relatively thin top layer. The laminate comprises resin impregnated paper sheets which have been subjected to pressure and heat to form a hardened rigid sheet product. The laminates can be made in any color and can have any imaginable pattern printed onto its surface. While relatively thin, i.e. up to about 50 mils in thickness, the laminates have all the characteristics needed in a surface top. They are readily cut to size and adhered to the corestock. Edge moldings are often used with the laminate to finish the surface top. The edge moldings, though, are limited in available shapes and tend to create a noticeable seam where they abut against the laminate surface top.

More recently there has been developed counter and vanity tops which are made by a casting process. Basically, a mold having the shape and size of a surface top is made and liquid resin cast into it. When set, a surface top is created which is durable and attractive. It can be transported and secured to base cabinets in the kitchen or bathroom. A side molding is adhered to the flat surface or the flat surface edge can be routed to a desired shape. However, the surface top is difficult to install because of its weight. Ideally, it is formed in the shop; this also is a drawback because of a need to transport it.

There is still a need for an improved surface top which has all the physical characteristics that the home owner and business proprietor have come to expect. Additionally, any such product must be attractive and readily installed. In accord with this need, there has now been developed an edge molding and surface top assembly which is readily installed and is amenable to varied design shapes. The resultant assembly is durable, resistant to food stains, liquid spills, accidental bumps and marrings, and possesses a long lasting attractiveness.

SUMMARY OF THE INVENTION

An edge molding for mounting on a corestock and interfacing with a substantially flat surface top forms a surface top assembly which has the appearance of a one-piece unit. The edge molding has a facing wall, an integral first ledge and an integral second ledge. Each of the ledges extend at substantially right angles from the facing wall. An inside face of the facing wall has at least one longitudinally running excess adhesive flow-out groove while the inside faces of each of the ledges have longitudinally running gripper ridges. The second ledge also preferably has a longitudinally running drip channel on its outside face. The edge molding is dimensioned to mount onto an edge of the corestock in a cooperative engagement with a surface top such that a seam formed by the side molding and surface top is virtually unnoticeable. Edges of the molding are capable of being routed to any desired shape.

DETAILED DESCRIPTION OF THE INVENTION

The edge molding and surface top assembly of the invention are described in detail in the following paragraphs and with particular reference to the drawings. The edge molding and the surface top can be made in an unlimited number of colors and printed patterns to suit the consumer's desires. Additionally, while only two edge shapes are illustrated, several other shapes can be formed into the assembly. The resins used in making the side molding and surface top are conducive to being easily pigmented and are conducive to being shaped by a router or other mechanical means to any desired shape.

Figure 1:
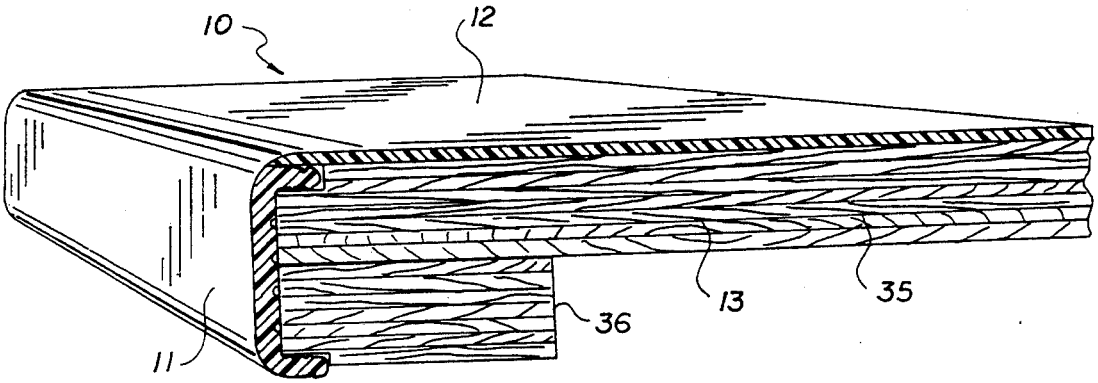
FIG. 1 is a perspective view in section showing a surface top assembly of the invention.
Figure 2:
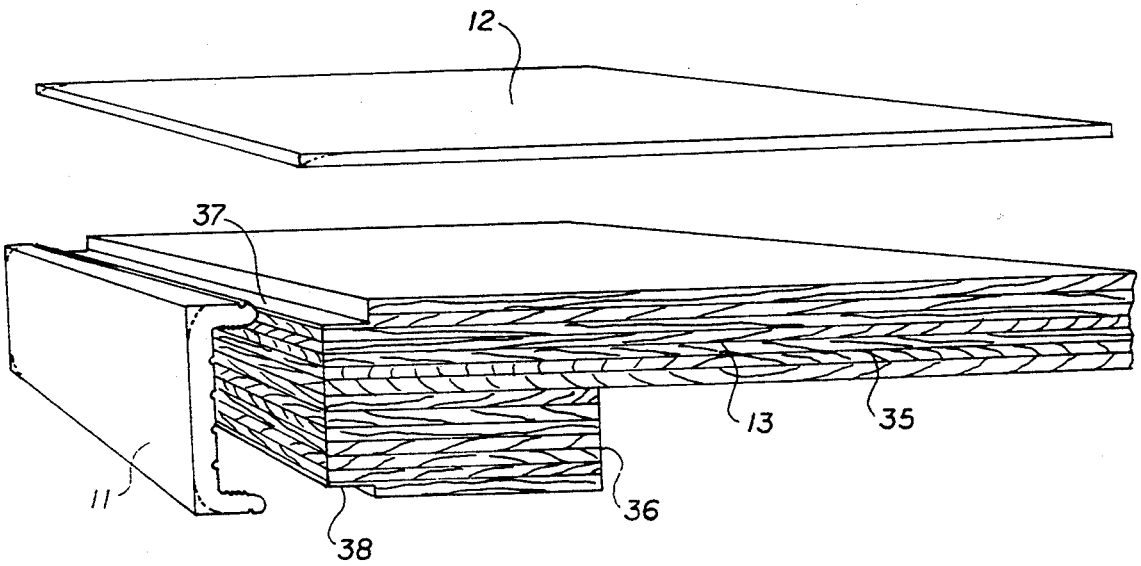
FIG. 2 is an exploded view of the surface top assembly of FIG. 1.

With reference to FIGS. 1 and 2, there is shown the surface top assembly 10 of the invention in the form of a kitchen counter. The assembly 10 comprises an edge molding 11 of the invention, a substantially flat surface top 12, and a corestock 13. The components of the surface top assembly 10 as well as its manner of installation on a set of base cabinets or other underlying support structure are described in the following paragraphs.

Figure 3:
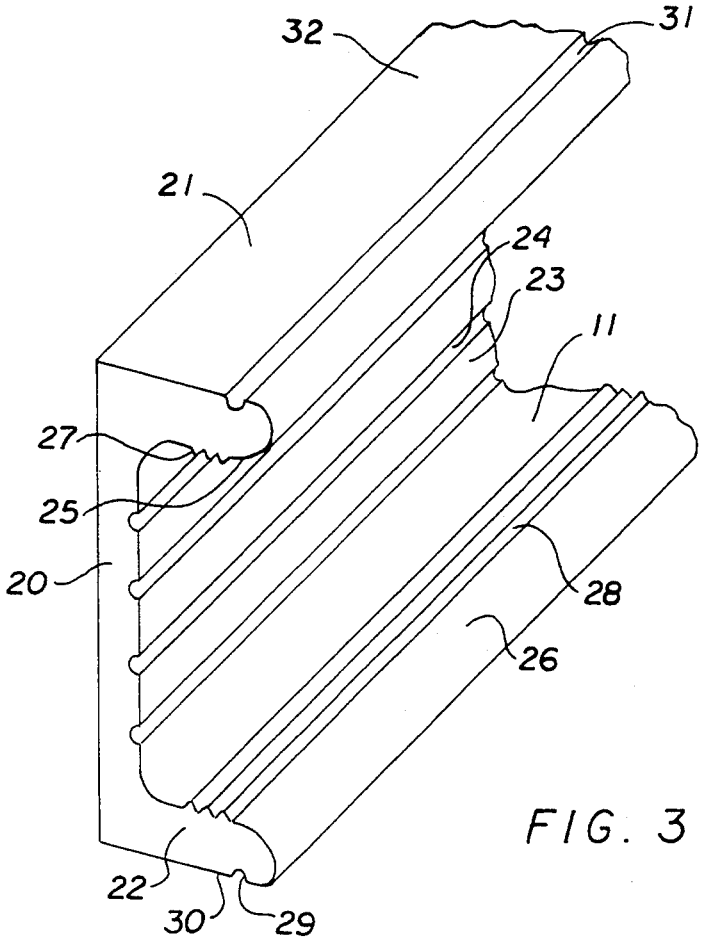
FIG. 3 is a perspective view of an edge molding used in the surface top assembly of FIG. 1.

The edge molding 11 best seen in FIG. 3 has an elongated body comprised of a facing wall 20, an integral first ledge 21 and an integral second ledge 22. The first and second ledges extend at substantially right angles to the facing wall 20. The facing wall is typically about one inch to about four inches in height, though can be greater for commercial uses. The width of the ledges is sufficient to extend over the corestock to provide a sturdy attachment, generally about one-fourth inch to about one inch width being adequate.

An inside face 23 of the edge molding's facing wall 20 has at least one, preferably three to five, longitudinally running excess adhesive flow-out grooves 24. An adhesive is used in installation of the edge molding to the corestock as described below. Any excess adhesive used in that step flows into the flow-out grooves 24. This aids in achieving a quicker and better adherence to the corestock.

The first ledge and the second ledge of the edge molding 11 each has a set of longitudinally running gripper ridges on an inside face. Again, with reference to FIG. 3, the inside face 25 of the first ledge 21 and the inside face 26 of the second ledge 22 have the gripper ridges 27 and 28, respectively. The ridges are generally V-shaped to present a surface which can more readily be forced over the corestock and retain its position once properly positioned. Preferably, the terminuses of the ledges are rounded to aid in positioning of the edge molding 11 over the corestock 13.

At least the second ledge 22 of the edge molding preferably has a longitudinally running drip channel 29 on an outside face 30 near the ledge's terminus. The drip channel serves the purpose of interrupting the flow of any spilled liquid which may run down the facing wall 20 and along the second ledge 22. The spilled liquid is caused to flow downwardly onto the floor when it hits the drip channel, which is preferred to its continuing to run laterally until it contacts the base cabinets. More preferably, the first ledge 21 also has a longitudinally running drip channel 31 on its outside face 32 near a terminus simply so that the edge molding is symmetrical as an aid in production and installation.

The edge molding of the invention is a one piece construction formed from a synthetic resin. It is extruded in lengths that typically extend up to about twelve feet long. A highly preferred synthetic resin which is used in its production is a polyester/polycarbonate resin commercially available from General Electric Co. as Nuvel resin.

The substantially flat surface top 12 used in the surface top assembly is made of the same synthetic resin as used in producing the edge molding 11. It is extruded as a flat sheet in widths and lengths dictated primarily by machine limitations as well as by handling and transportation limitations. Typically, sheets of the surface top range from about two and one-half feet to about five feet in width and about: eight feet to about twelve feet in length. Its thickness is not critical, though a sheet thickness of from about 75 mils to about 100 mils is optimum for the end use intended.

The corestock 13 forming a part of the surface top assembly 10 provides a substantially rigid substrate on which the edge molding 11 and surface top 12 are adhered. Such corestock are commonly used in surface top assemblies. They are made from wood, plywood, flakeboard, particle board, and other wood composites or any other rigid material which is capable of being formed or cut into the shape and size needed. As evident in FIGS. 1 and 2, the corestock 13 has a main body 35 of substantially uniform thickness which sits on the base cabinets and a shoulder 36 extending along the bottom of the main body 35 near at least one edge thereof. The side edge of the corestock further has a top open-sided channel 37 and a bottom open-sided channel 38 cut into its top and bottom surfaces to receive the first and second ledges respectively of the edge molding 11. The channels have a depth and width dependent on the dimensions of the edge molding so as to snugly receive the molding.

Installation of the surface top assembly of the invention is readily accomplished. The main body of the corestock is initially cut to size to fully overly an underlying support structure such as a set of base cabinets. The main body of the corestock typically overhangs the support structure so that exposed edge areas are created. Shoulders are added to the corestock on the underside of the exposed edges. Top and bottom channels are routed into the side edge areas. Next, the edge molding has a color-matched adhesive applied to its inside surfaces and then positioned over the side edge of the corestock. It is forced into position by tapping its facing wall until its first and second ledges fit fully into the channels. The surface top now has an adhesive applied to its underside and positioned onto the corestock. One of its edges slightly overlaps the first ledge of the edge molding. After the adhesive has set, the mechanic can optionally route the top and bottom outside edges of the edge molding to give them any desired shape, e.g. rounded, ogee, etc. The resultant surface top assembly has the appearance of a unitary construction. The seam formed by the overlap of edge molding to the flat surface top is virtually unnoticed.

Figure 4:
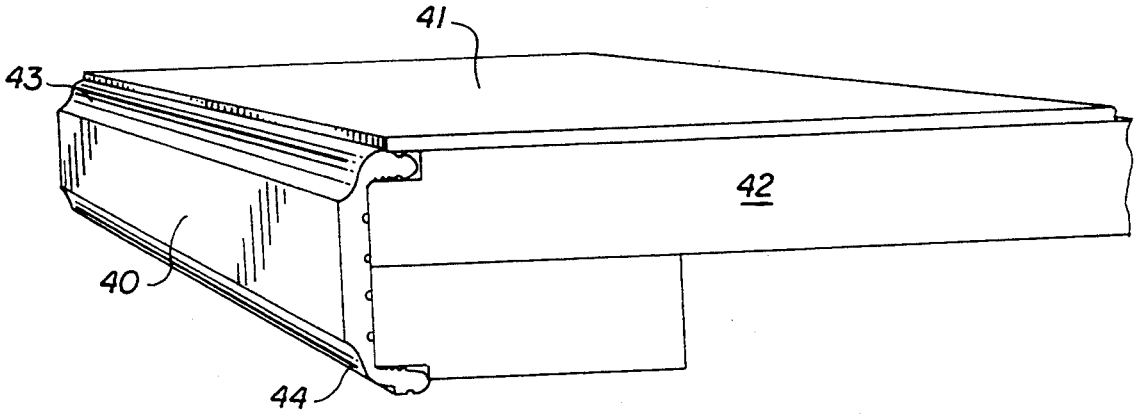
FIG. 4 is a perspective view of another surface top assembly of the invention showing an alternative shaped edge which has been routed into its edge molding.

FIG. 4 illustrates another surface top assembly of the invention having a different edge treatment. The edge molding 40, substantially flat surface top 41 and corestock 42 are the same as described above. However, the top outside edge 43 and the bottom outside edge 44 of the edge molding 40 are routed to an ogee shape.

Figure 5:
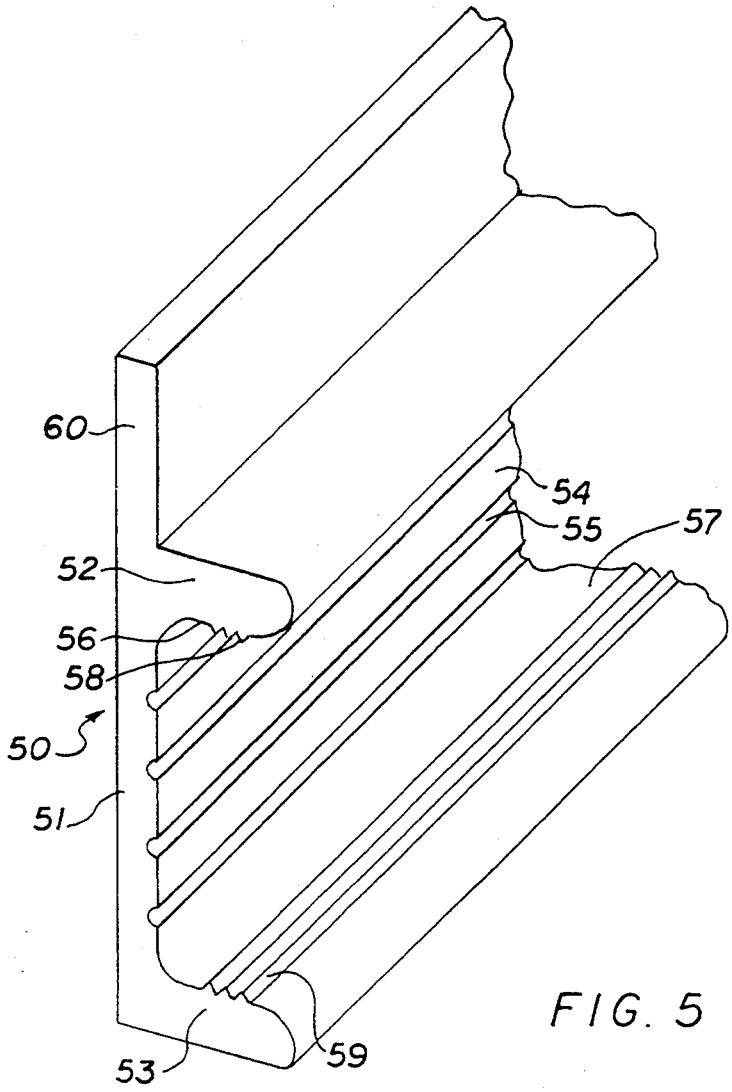
FIG. 5 is a perspective view of another edge molding of the invention which has a scribe wall.
Figure 6:
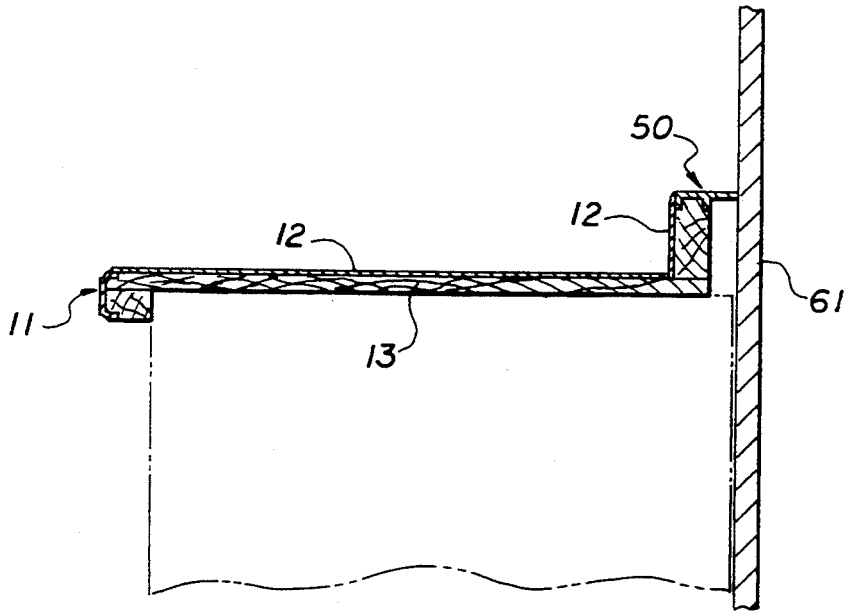
FIG. 6 is a perspective view in section of a surface top assembly utilizing the edge molding of FIG. 5.

With reference to FIGS. 5 and 6, there is shown another edge molding of the invention. The edge molding 50 is intended to serve as a back splash cap to a kitchen counter top assembly. It comprises a facing wall 51 having an integral first ledge 52 and an integral second ledge 53, each of which extends at a substantially right angles from the facing wall 51. Similar to the edge molding 11 above described with reference to FIGS. 1–3, the inside face 54 of the facing wall has at least one longitudinally running excess adhesive flow-out groove 55 and the inside face 56 of the first ledge 52 and the inside face 57 of the second ledge 53 each has a set of longitudinally running gripper ridges 58 and 59, respectively.

The edge molding 50 also has a scribe wall 60 extending in the same plane from the facing wall 51. As evident in FIG. 6, the edge molding is positioned on a corestock in a manner similar to that described above with respect to the edge molding 11. The scribe wall is cut to fit any surface irregularities in the kitchen wall 61. An edge of the second ledge is routed to any desired shape.

The edge molding and the surface top assembly of the invention have been described in detail and with particular reference to the drawings. It should be understood modifications and changes of an obvious nature can be made. Embodiments of the invention including such modifications and changes are considered within the scope of the appended claims.

I claim:

1. An edge molding for mounting on a corestock in a cooperative relationship with a surface top to interface with an edge of the surface top whereby a seam formed by the edge molding and surface top is virtually unnoticeable, said edge molding comprising a facing wall having an integral first ledge and an integral second ledge each of which extends at a substantially right angle from the facing wall, wherein an inside face of the facing wall has at least one longitudinally running excess adhesive flow-out groove for receiving excess adhesive applied to said inside face during installation onto the corestock, each inside face of the first and second ledges has a set of longitudinally running gripper ridges extending therealong to aid in holding the side molding to the corestock, and an outside face of at least one of the ledges has a longitudinally running drip channel to cause an interruption in the flow of any spilled liquid along an underside of the edge molding.

2. The edge molding of claim 1 wherein the first and second ledges each has a longitudinally running drip channel on an outside face to aid in production of the side molding and its installation.

3. The edge molding of claim 2 wherein there are from three to five excess adhesive flow-out grooves in the inside face of the facing wall.

4. The edge molding of claim 1 wherein a terminus of each of the first and second ledges is rounded to aid in its installation onto the corestock.

5. The edge molding of claim 1 wherein the gripper ridges on the inside face of the first ledge and the second ledge are V-shaped to aid in the edge molding's installation and retention on the corestock.

6. The edge molding of claim 1 wherein said molding is made of a synthetic resinous material which is capable of being mechanically shaped.

7. The edge molding of claim 1 further comprising a scribe wall extending from the facing wall so as to be in a same plane as the facing wall.

8. The edge molding of claim 1 wherein the ledges extend from about one-fourth inch to about one inches from the facing wall.

9. A surface top assembly for installation on an underlying support structure, said assembly comprising:

(a) a substantially rigid corestock having a substantially flat main body wherein at least one side edge thereof has a top open-sided channel and a bottom open-sided channel extending therealong;

(b) an edge molding adhesively secured to the at least one side edge of the corestock and dimensioned to fit into the top and bottom channels of the corestock and cover said side edge, said edge molding comprising a facing wall having an integral first ledge and an integral second ledge each of which extends at a substantially right angle from the facing wall, wherein an inside face of the facing wall has at least one longitudinally running excess adhesive flow-out groove for receiving excess adhesive applied to said inside face during installation onto the corestock, each inside face of the first and second ledges has a set of longitudinally running gripper ridges extending therealong to aid in holding the side molding to the corestock and an outside face of the second flange has a longitudinally running drip channel to cause an interruption in the flow of any spilled liquid along an underside of the edge molding; and (c) a substantially flat surface top adhesively secured to the corestock and positioned to overly a portion of the edge molding.

10. The surface top assembly of claim 9 wherein the corestock further has a shoulder extending along the underside of the main body at the side edge thereof.

11. The surface top assembly of claim 10 wherein the edge molding has from three to five excess adhesive flow-out grooves in the inside face of its facing wall.

12. The surface top assembly of claim 10 wherein a terminus of each of the first and second ledges of the edge molding is rounded to aid in its installation onto the corestock.

13. The surface top assembly of claim 10 wherein the gripper ridges on the inside face of the first ledge and the second ledge of the edge molding are V-shaped to aid in the edge molding's installation and retention on the corestock.

14. The surface top assembly of claim 9 wherein the edge molding and the substantially flat surface top are made of a synthetic resinous material which is capable of being mechanically shaped.

15. An edge molding for mounting on a corestock in a cooperative relationship with a surface top to interface with an edge of the surface top whereby a seam formed by the edge molding and surface top is virtually unnoticeable, said edge molding comprising a facing wall having an integral first ledge and an integral second ledge each of which extends at a substantially right angle from the facing wall, wherein an inside face of the facing wall has from three to five longitudinally running excess adhesive flow-out grooves for receiving excess adhesive applied to said inside face during installation onto the corestock, each inside face of the first and second ledges has a set of longitudinally running gripper ridges extending therealong to aid in holding the side molding to the corestock, and an outside face of at least one of the ledges has a longitudinally running drip channel to cause an interruption in the flow of any spilled liquid along an underside of the edge molding.

16. The edge molding of claim 15 wherein the first and second ledges each has a longitudinally running drip channel on an outside face to aid in production of the side molding and its installation.

17. The edge molding of claim 15 wherein a terminus of each of the first and second ledges is rounded to aid in its installation onto the corestock.

18. The edge molding of claim 17 wherein said molding is made of a synthetic resinous material which is capable of being mechanically shaped.

19. An edge molding for mounting on a corestock in a cooperative relationship with a surface top to interface with an edge of the surface top whereby a seam formed by the edge molding and surface top is virtually unnoticeable, said edge molding comprising a facing wall having an integral first ledge and an integral second ledge each of which extends at a substantially right angle from about one-fourth inch to about one inch from the facing wall, wherein an inside face of the facing wall has at least one longitudinally running excess adhesive flow-out groove for receiving excess adhesive applied to said inside face during installation onto the corestock and each inside face of the first and second ledges has a set of longitudinally running gripper ridges extending therealong to aid in holding the side molding to the corestock.

20. The edge molding of claim 19 wherein an outside face of at least one of the ledges has a longitudinally running drip channel to cause an interruption in the flow of any spilled liquid along an underside of the edge molding.

21. The edge molding of claim 20 wherein there are from three to five excess adhesive flow-out grooves in the inside face of the facing wall.

22. The edge molding of claim 21 wherein a terminus of each of the first and second ledges is rounded to aid in its installation onto the corestock and further wherein the gripper ridges on the inside face of the first ledge and the second ledge are V-shaped to aid in the edge molding's installation and retention on the corestock.

23. The edge molding of claim 22 wherein said molding is made of a synthetic resinous material which is capable of being mechanically shaped.

* * * * *